US005980358A

United States Patent [19]

Diller

[11] Patent Number: 5,980,358

[45] **Date of Patent: *Nov. 9, 1999**

[54] VEHICLE FOR ELECTRIC TOY AND MODEL TRAINS

[75] Inventor: Hans Diller, deceased, late of Heroldsberg, Germany, by Gereda Diller, administrator

[73] Assignee: Gebr. Fleischmann, Nuremberg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/263,852

[22] Filed: Jun. 22, 1994

[30] Foreign Application Priority Data

Jun. 24, 1993 [DE] Germany ..... 43 20 989

[51] Int. Cl.[6] ..... A63H 19/02

[52] U.S. Cl. ..... 446/467; 446/468; 446/469; 446/465; 105/29.2

[58] Field of Search ..... 446/236, 237, 446/269, 410, 431, 433, 437, 441, 444, 445, 448, 451, 460, 465, 467, 468, 469, 489; 105/29.2, 157.1, 157.2

[56] References Cited

U.S. PATENT DOCUMENTS

| | | | |
|---|---|---|---|
| 1,791,660 | 2/1931 | Corey | 446/447 |
| 2,522,317 | 9/1950 | Stewart . | |
| 3,063,194 | 11/1962 | Berguerand | 446/466 |
| 4,799,431 | 1/1989 | Edwards et al. . | |

FOREIGN PATENT DOCUMENTS

| | | | |
|---|---|---|---|
| 1269304 | 7/1961 | France . | |
| 1240452 | 2/1958 | Germany . | |
| 1180293 | 10/1964 | Germany | 446/467 |
| 971782 | 10/1964 | United Kingdom | 446/466 |

OTHER PUBLICATIONS

Hornsby Railroads, 29th Edition, 1983 catalog, cover page and pp. 6 and 7.

*Primary Examiner*—Sam Rimell
*Attorney, Agent, or Firm*—Jordan and Hamburg LLP

[57] ABSTRACT

A vehicle for electric toy and model trains with a freight car body, which is suspended in a free-floating fashion over overrunning inclinations at superstructures of the carriages passing through its bottom in such a manner, that the pivoting angle is positively controlled proportionally by the rotation of the carriages when passing through curves, in the case of a carriage, the superstructures and the freight car body being provided with curve grooves or suspension pins, which engage the curve grooves and are disposed horizontally and transversely to the longitudinal axis, and that the other carriage is not guided and is hooked in a self-aligning fashion to the freight car body.

18 Claims, 6 Drawing Sheets

VEHICLE FOR ELECTRIC TOY AND MODEL TRAINS

The invention relates to a vehicle for electric toy and model trains with a freight car body which is suspended in a free-floating manner over overrunning inclinations at superstructures of the carriages passing through its bottom in such a manner that the pivoting angle is positively controlled proportionally to the rotation of the carriage when passing through curves.

BACKGROUND OF THE INVENTION

In order to be able to let trains pass with greater comfort for the user and, moreover, also with greater speeds over curved sections, it is known from the industrial example that the vehicle superstructures can be disposed pivotably about a longitudinal axis on the chassis part with the carriage so that the passenger car can bank on the curve and, with than, counteract centrifugal forces.

In the case of the industrial example, a solution has become known, for which a sensor scans the rails optically in order to arrange for a hydraulic swiveling adjustment of the freight car body from the therefrom calculated radius of the curve in conjunction with the measured speed. It is obvious that this is an extremely complicated method which is not suitable for electrical toy and model trains.

For applying this design principle to such electrical toy and model trains, a vehicle of the initially-described type has become known, which is described, for example, in the "Hornby Railways" catalogue, Aug. 29, 1983, page 6. Next to the stanchions of the carriages, on which the sloping ramps, disposed under the roof of the freight car body, are supported, hooks, which are offset by 90° relative to these, are additionally provided. These hooks are intended to prevent the freight car body and the carriages from coming apart. However, this type of suspension without a central, self-aligning axis of rotation leads to considerable slackness in the suspension, which reflects itself in a driving behavior which contradicts the industrial example and is unsuitable for the present-day strict demands of toy train devotees.

SUMMARY OF THE INVENTION

It is therefore an object of the invention to design a vehicle of the type named above in such a way, that there is a more exact, rotating-swiveling connection with less slackness between the carriages and the freight car body.

This objective is accomplished pursuant to the invention owing to the fact that the superstructures and the freight car body of the carriage are provided with curve grooves or suspension pins, which engage the curve grooves and are disposed horizontally and transversely to the longitudinal axis, and that the other carriage is not guided, but suspended in a free-floating fashion at the freight car body.

Due to the inventive arrangement of the suspension pins, which engage the curve grooves, the freight car body guidance is self-aligning and, when the carriage is rotated, it is simultaneously suspended at the freight car body so that additional suspending devices are avoided.

Particularly advantageously pursuant to a first embodiment of the invention, the superstructures can be lateral stanchions, cylindrical on the outside, which engage corresponding, preferably also cylindrical, circular guides at the interior walls of the freight car body, the suspension pins and the curve grooves being disposed in the overlapping guiding region. As in the case of the vehicle of Hornby, which has been described, this provides the possibility of disposing the driving motor on one of the carriages. However, the major advantage lies therein that the self-aligning suspension need not take place under the roof of the freight car body which would require appropriately high lateral stanchions. Instead, the whole of the suspension can take place in the bottom region, which also permits a considerably larger pivoting angle.

Although it would, of course, also be possible to dispose the pins at the superstructures of the carriages and the curve grooves in the freight car body, it has proven to be particularly advantageous in practice that pins, snapping inward from the circular guides, protrude into preferably inwardly closed curve grooves on the external sides of the stanchions. This avoids higher assemblies on the inside of the freight car bodies, since the curve grooves can be disposed with far fewer problems at the lateral guiding stanchions which are necessary anyhow.

In order to avoid difficulties when passing through S curves, the second carriage of each vehicle need not be provided with an inventive, self-aligning guiding system, since otherwise the danger would exist that one carriage tends to tilt the freight car in one direction and the other carriage tends to tilt in the other direction, which necessarily would lead to damage to the vehicle and to derailing. The second carriage shall therefore be connected with the freight car body by a pivot pin guiding device with clearance, so that despite the disadvantages arising therefrom that, when this carriage moves ahead, banking takes place only when the trailing carriage reaches the curve area the self-aligning freight car body is not steered in opposite directions by the two carriages.

Particularly for traction vehicles for narrow gauge tracks (gauge N), provisions can be made pursuant to a second embodiment of the present invention that the superstructures comprise lateral guiding surfaces, cylindrical on the inside, for counterstay webs, which have web walls, engage in between the guide surfaces and are provided with continuous curved slots for a preferably detachable pin passing through the web walls.

This embodiment of an inventive vehicle has the particular advantage that, for example, the pin can form the axle of a transmission radial gear, which is disposed between the web walls and engages, on the one hand, the driven worm of the motor shaft that lies above in the longitudinal direction of the vehicle and, on the other hand, the gearwheel that is connected with the wheel axles so that, particularly when the radial gear has teeth that come to a crest, a driving connection over the self-aligning suspension at the carriage from a driving motor, disposed within the superstructure of the vehicle, to the wheels of the carriage is possible.

For the usual construction of vehicles for electrical toy and model trains with laterally pivotable coupling shafts on the freight car bodies with a coupling pocket accommodating the coupling head, provisions are made in a refinement of the invention that either the coupling shafts or the coupling heads are rotatable about their longitudinal axis in the coupling pockets or, preferably, that the coupling heads are rotatable about the longitudinal axis and engage one another.

In the case of this preferred, latter embodiment with rotatable, mutually engaging coupling heads, provisions can be made so that either the head pins, at one end plate of a coupling head, pass through an end plate of the counter-coupling head in circular slots with terminal threading enlargements, one of the end plates optionally additionally having a centering pin engaging a borehole of the counterplate, or that one of the coupling heads has a mushroom-shaped shoulder, which can be hooked through a lateral longitudinal slot in an expanded accommodating borehole of the counter-head.

In deviation from the usual means of fastening coupling parts to vehicles, provisions can also be made, particularly for the inventive vehicles with a self-aligning superstructure, that the coupling parts in each case are fastened to the carriages, which makes it necessary that the coupling parts be mutually rotatable about their longitudinal axis.

As a result, the advantageous possibility arises of constructing a tight coupling, in that a tight coupling shaft, elastically braced in the mid-position, is fastened pivotably to the carriage and engages with a guide pin a connecting link guide at the bottom of the freight car in much the same way as is described in German Patent P 40 20 756 in connection with a tight coupling which is disposed completely at the freight car body.

In this connection, it has proven to be particularly advantageous that the fastening bearing bolt of the carriage passes with clearance through a lug supported with a rounded tip at the bottom of the freight car. This results not only in a particularly simple pivotal bearing of the carriage at the vehicle bottom, but also in a quasi cardanic suspension, which also has special advantages when riding over undulating sections of rail, particularly when passing over mountain tops or through valleys.

Further advantages, distinguishing features and details of the invention arise out of the following description of some embodiments shown in the accompanying drawings.

DESCRIPTION OF THE PREFERRED EMBODIMENTS

Figure 1:
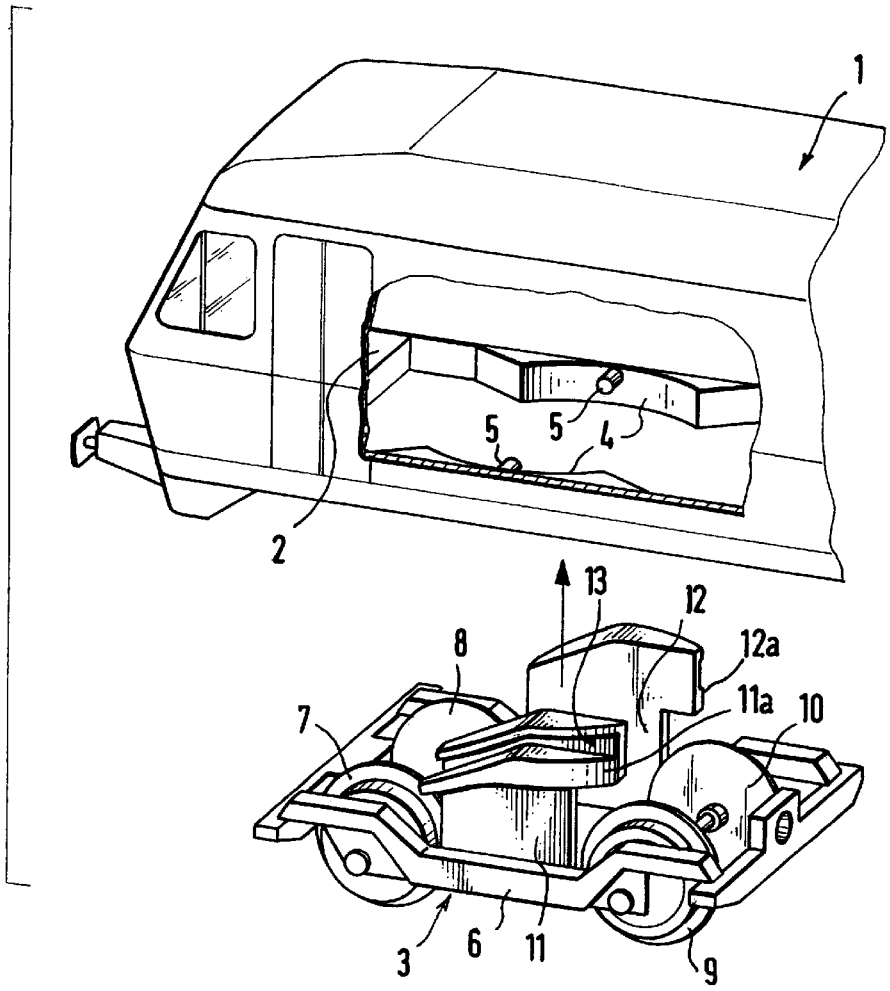
FIG. 1 is a perspective view of the front parts of a car body with the carriage for a self-aligning guiding suspension below in the disassembled state.
Figure 2:
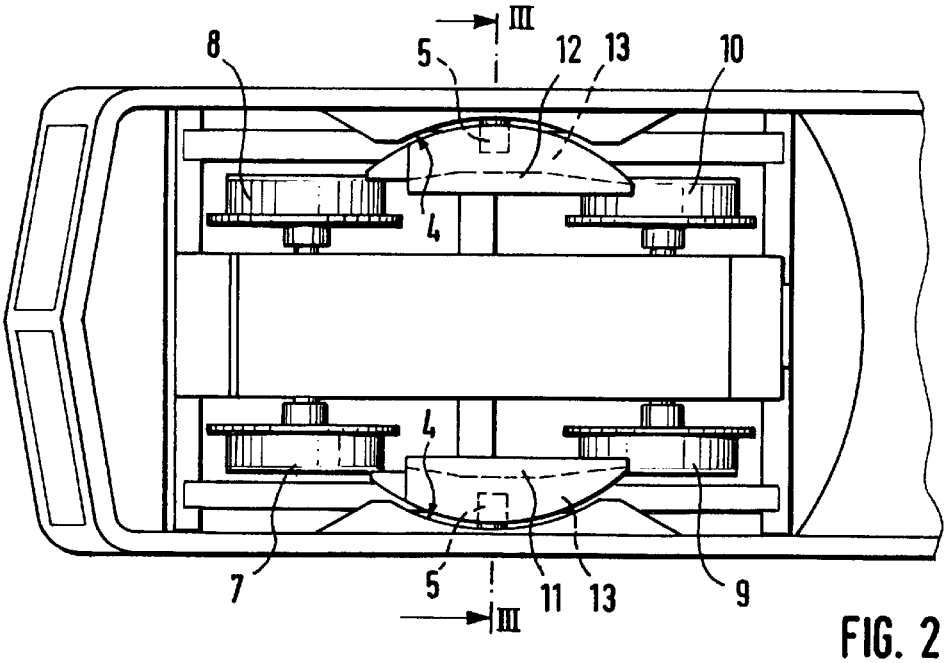
FIG. 2 is a plan view of the carriage from above, with an imaginary roof that is cut open, in the position in which the carriage runs straight ahead on straight rails.
Figure 3:
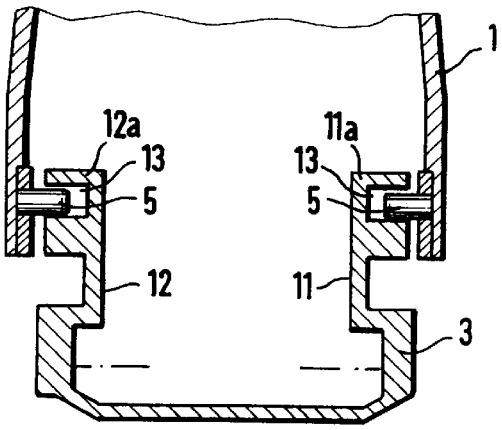
FIG. 3 is a cross-section taken along the line III—III in FIG. 2.
Figure 4:
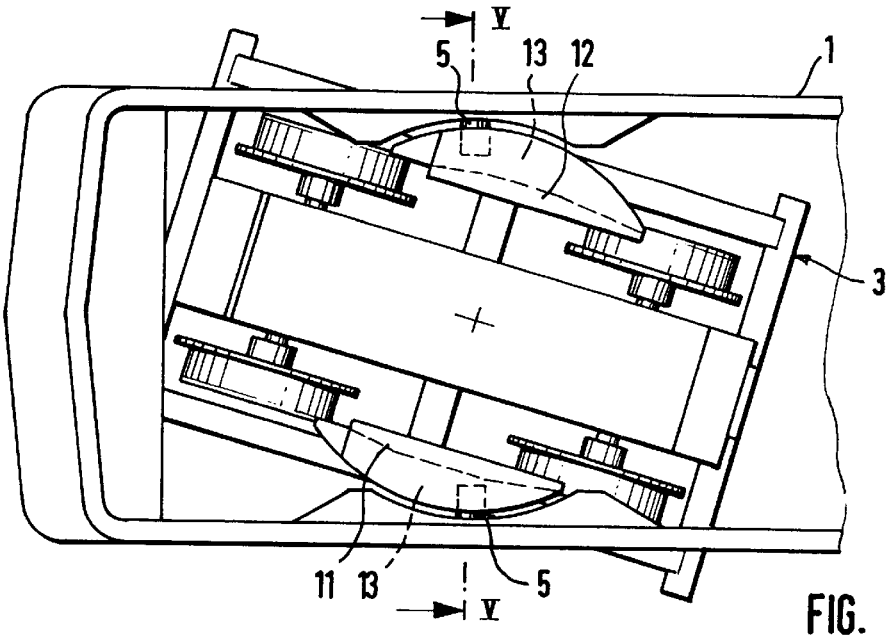
FIG. 4 is a plan view corresponding to that of FIG. 2 at a curve of the rails with an appropriately deflected carriage.
Figure 5:
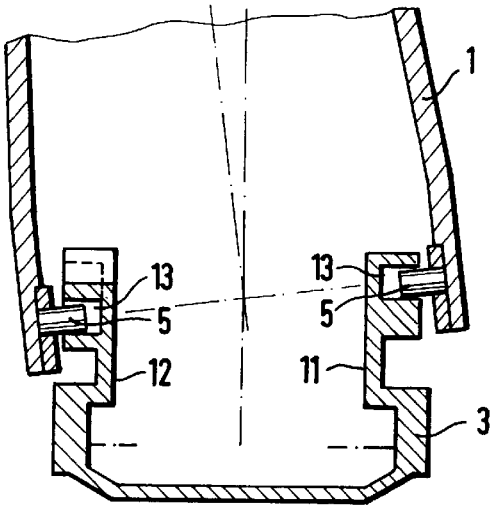
FIG. 5 is a cross-section taken along the line V—V of FIG. 4.
Figure 6:
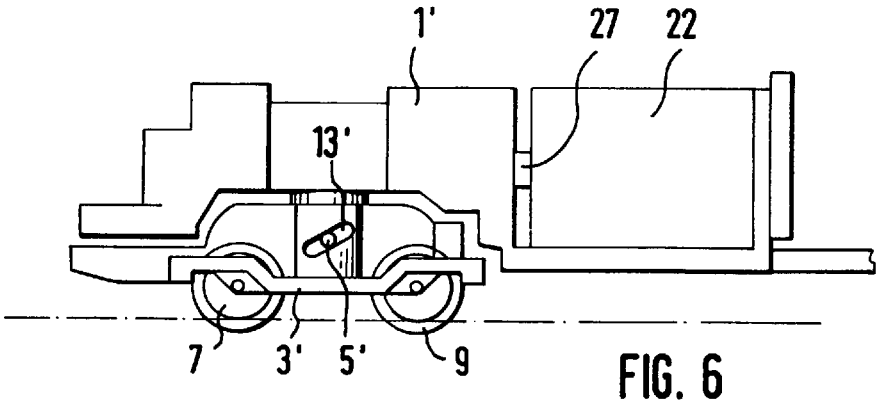
FIG. 6 is a diagrammatic partial side view of a vehicle, especially for an N track, with a drive motor disposed in a horizontal position in the vehicle superstructure and a drive connection between the motor and the wheels of the carriage over a free-floating suspension.
Figure 7:
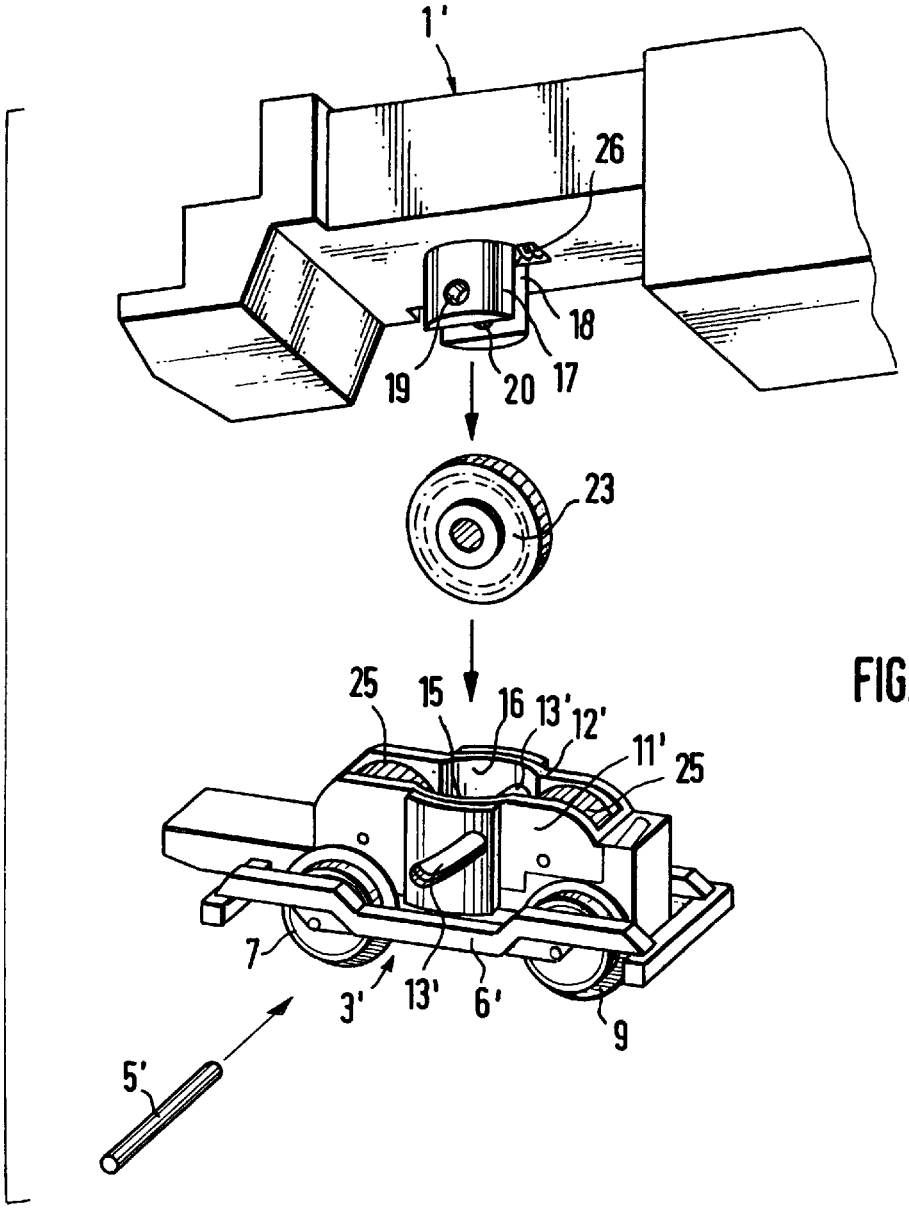
FIG. 7 is an enlarged, perspective, exploded representation of the carriage and the driving connection to the driving motor above the carriage.
Figure 8:
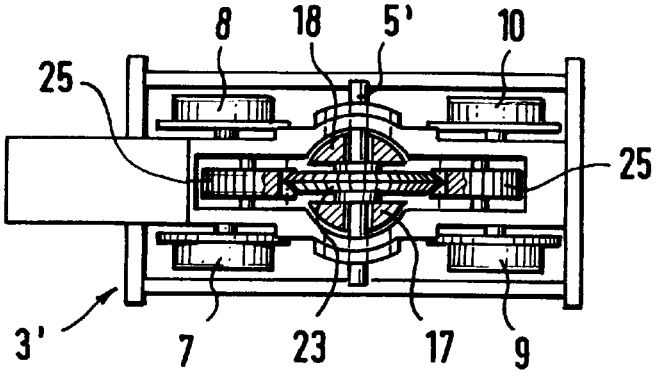
FIG. 8 is a simplified plan view of the carriage.
Figure 9:
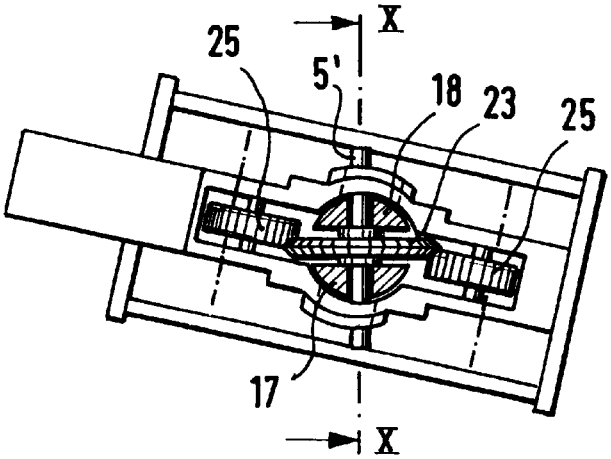
FIG. 9 is a plan view corresponding to that of FIG. 8, as the vehicle is passing through a curve.
Figure 10:
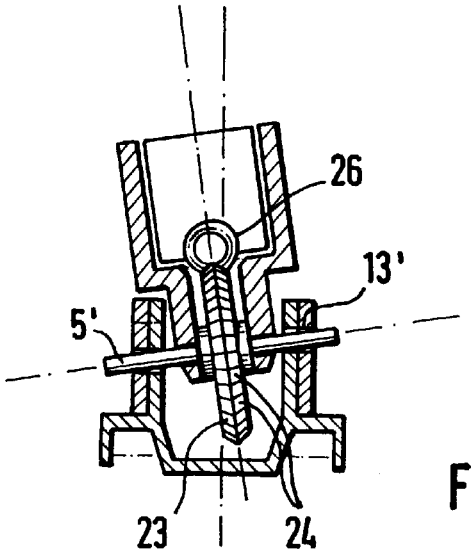
FIG. 10 is a sectional view taken along the line X—X of FIG. 9 with the gear parts of the motor drive.

In FIG. 1, there is shown an end section of a freight car body 1, the bottom 2 of which is provided in the region of the carriage 3 with a recess which comprises lateral, circular guides 4 with suspension pins 5 which protrude inward. At the carriage box 6, at which the wheels 7 to 10 are rotatably mounted on bearings, lateral superstructures in the form of stanchions 11 and 12, cylindrical on the outside, are integrally molded. The stanchions 11 and 12 are provided on the outside with curved grooves 13 which are engaged by the suspension pins 5. The at least partially external, cylindrical shape of the stanchions 11 and 12 must be present particularly in the region of the curve grooves, that is, in the upper sections 11*a* and 12*a*, and forms a counter guide for the circular guides 4 so that in conjunction with the suspension pins 5 engaging the curve grooves 113, a quasi cardanic suspension is achieved, for which at the same time also a captive mounting of the carriages on the freight car body is obtained. If the carriage 6 is rotated relatively to the longitudinal axis of the vehicle, that is, when passing through curves, the suspension of the pins 5 in the curve grooves 13 results in a rotation of the freight car body 1, as shown particularly clearly in FIGS. 4 and 5. In order to keep the clearance, which is necessary for tilting, as small as possible, the circular guides 4 and the sections 11*a*, 12*a*, of the stanchions 11, 12 containing the curve grooves 13 can also be rounded off in the vertical direction, that is, provisions could be made that these sections represent cutouts from spherical surfaces.

In the case of the driving vehicle for toy and model trains shown in FIGS. 6 to 10 with a self-aligning, suspended freight car body, this freight car body, which is shown only partially and diagrammatically in the drawings, is labelled 1', while the carriage, which brings about the self-aligning guidance, carries the reference symbol 3'. The carriage frame 6' carries web walls, which are spaced apart laterally and in the middle section form cylindrical guiding surfaces 15 and 16 for counterguiding webs 17 and 18 of the freight car body 1 engaging in between. The webs 17, 18 and provided with aligned boreholes 19 and 20 for a suspension pin 5' which passes through the curve slots 13' of the web walls 11', 12'. When the carriage 3' is rotated relative to the longitudinal axis of the vehicle, there is a self-aligning rotation of the vehicle superstructure 1' at the carriage, as in the embodiment of FIGS. 1 to 6 and as can be seen particularly by means of FIGS. 9 and 10. A special feature of the embodiment of FIGS. 6 to 10 lies therein that the transmission connection from the driving motor 22, disposed in the vehicle superstructure 1' of the wheels 7 to 10 of the carriage, over the self-aligning bearing guidance is possible. For this purpose, a transmission radial gear 23, the tips 24 of the teeth of which come to a crest axially, is supported on the suspension pin as a bearing axle. On the one hand, the transmission radial gear 23, with gearwheels 25, which mesh with gearwheels on the carrying axle of the wheel pairs 7, 8 or 9, 10 and, on the other engage a screw 26 at the end of the drive shaft 27 of the driving motor 22.

In order to or conversely to minimize the lateral clearance of the suspension of the carriage at the freight car body also in the present case, provisions can be made so that the guide surfaces 15, 16 on the inside and, in the same way also, on the outside of the counter-guiding webs 17 and 18 at the freight car body are constructed spherically.

Figure 11:
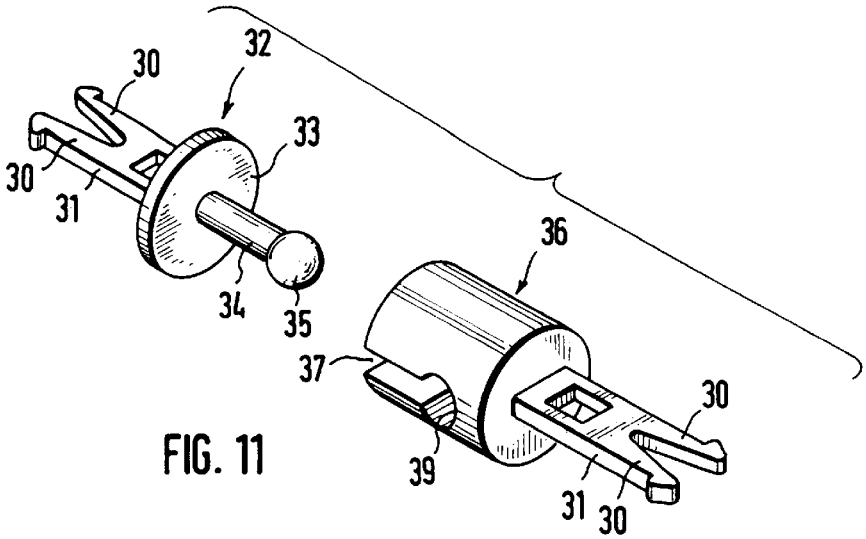
FIG. 11 is a perspective view of the coupling heads of a coupling for invention vehicles with a self-aligning, suspended freight car body.
Figure 12:
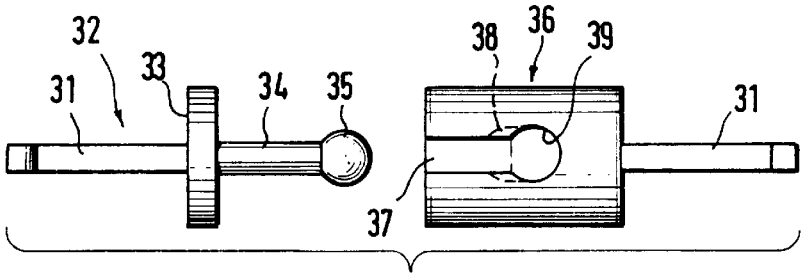
FIG. 12 is a side view of the coupling heads of FIG. 11.
Figure 13:
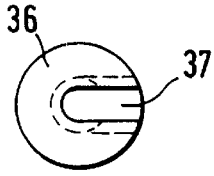
FIG. 13 is a front view of the right accommodating coupling head of FIGS. 11 and 12.

FIGS. 11 to 13 show the coupling heads of a coupling particularly for vehicles with self-aligning freight car bodies similar to those of FIGS. 1 to 10, the coupling parts being fastened in the usual manner to the freight car bodies themselves. The coupling shaft and the coupling pocket accommodating the coupling coupling head are not shown, since usually the coupling pocket is constructed so that the coupling head can be inserted with a slotted plug-in end 31, forming two hook arms 30, into such a coupling pocket so as to lock the coupling. For the embodiment of a coupling shown in FIG. 12 and 13, a stop plate 33, beyond which projects a mushroom-shaped prolongation 34 with a spherical head 35, is integrally molded with the plug-in part 31 of the one coupling head 32. The associated accommodating head 36 with a similar plug-in part 31 has a longitudinal borehole 37 with an accommodating borehole 38, expanded for the spherical head 35, as well as a lateral longitudinal slot 39, through which the prolongation 34 can be threaded from the side. Due to a pull that takes place when the vehicle starts and the corresponding longitudinal displacement, the head 35 reaches the region of the accommodating borehole 38, which no longer coincides with the threading expansion 39 of the lateral longitudinal slot, so that a lateral, automatic unhooking need not be feared. This type of construction of the coupling heads enables the coupling heads to be rotated relative to one another about their longitudinal connection axis, so that the freight car body of the first freight car and of the coupled rear freight car can be tilted independently on one another, as is, after all, also the case when the first is traversing a curve, while the second is still on a straight track.

Figure 14:
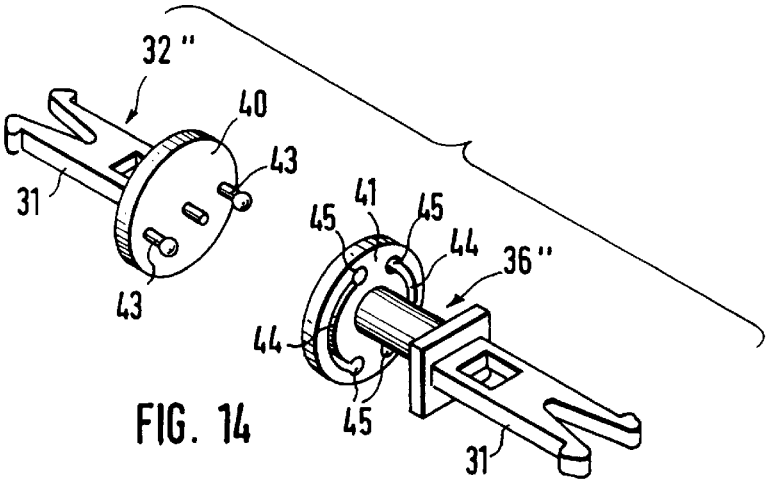
FIG. 14 is a perspective view of a second embodiment of the coupling heads for inventive vehicles with self-aligning coupling construction.

FIG. 14 shows a different embodiment of such a coupling, which can be rotated about the longitudinal axis. The coupling heads 3211 and 3611 shown there, once again with plug-in prolongations 31, are provided in each case with an end plate 40 or 41, of which the former has two head pins 43, which grip behind the circular slots 44 of the latter, threading expansions 45 for threading being provided at the ends of the circular slots 44. The threading expansions are provided offset in such a way, that the threading can take place only by tilting the vehicle super-structures about extremely opposite positions to one another. Such extreme opposite positions cannot occur in practice even in tight S curves, so that automatic uncoupling cannot take place.

Figure 15:
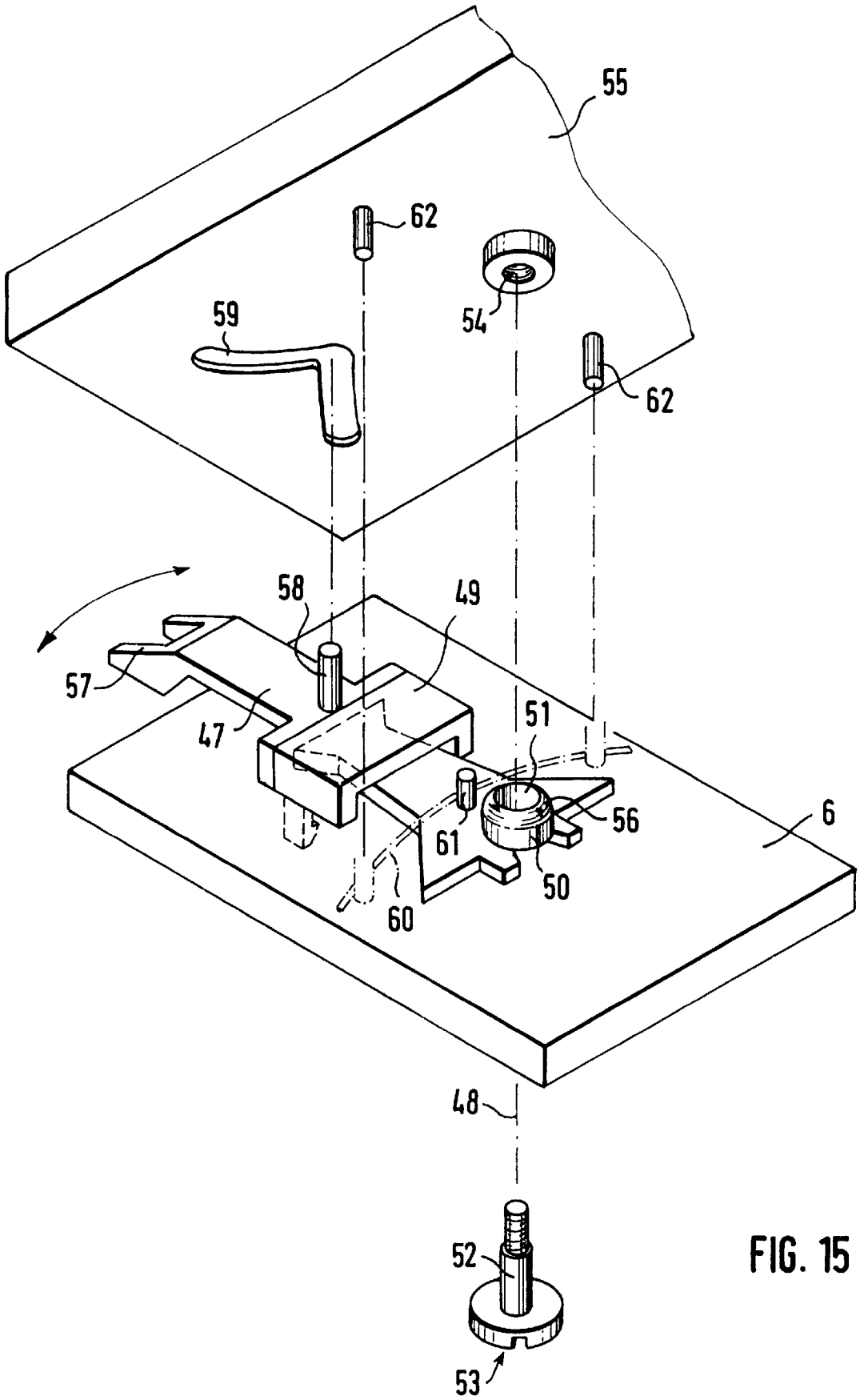
FIG. 15 is a perspective exploded representation of a tight coupling, particularly for vehicles with a self-aligning, suspended freight car body.

Finally, in FIG. 15, a tight coupling is shown diagrammatically, which is suitable particularly for the self-aligning superstructures of the present invention but also entails advantages for other vehicles without self-aligning superstructures. For this embodiment, the coupling shaft 47 is hinged pivotably about the axis 48 at an only diagrammatically indicated carriage frame 6 of an otherwise not shown carriage, the bridge-shaped component 49, which can be locked with the carriage frame 6 by recesses in the latter that are not shown, serving for fixing to the carriage frame. The coupling shaft 47 is supported at a lug 50 with an internal borehole 51, which is larger than the diameter of the part 52 of a fastening bearing bolt 53 assigned to it, which can be screwed into a tapped hole 54 in the bottom 55 of the freight car. The free tip 56 of the lug 50 is rounded, so that the carriage is supported quasi cardanically at the bottom 55 of the freight car with the help of the fastening bearing bolt and not only the sideways tipping motions of the freight car body with the freight car bottom 55 are possible in accordance with the self-aligning steering described further above, but also the tilting of the longitudinal axes of the freight cars when passing over hills or through valleys, can be compensated for. A guiding lug 58, which engages a connecting link guiding system 59 at the bottom of the freight car, is disposed in a known manner at the coupling shaft 47 with the coupling pocket 57 for accommodating a coupling head that it not shown. This guiding lug 58 must be constructed relatively long, so that it constantly engages the connecting link guiding system 59 even during the above-mentioned tilting motions about the longitudinal axis of the freight car or transversely thereto. At 60, a known restoring spring is indicated, which is placed around the pin 61 of the guiding shaft on the one hand and around the pins 62 at the bottom of the freight car in the manner indicated by the lines of dots and dashes, in order to pretension the coupling shaft in the mid-position.

It is claimed:

1. An electric toy train adapted to run on a track and to automatically tilt about a generally horizontal axis upon encountering and negotiating a curve in said track comprising a car body having a longitudinal axis, said car body having first guide means, at least one carriage underlying said car body, said carriage having at least two parallel axles spaced from one another in a direction parralle to said longitudinal direction, each of said axles having two wheels adapted to run on said track, said carriage having second guide means, one of said first and second guide means comprising a groove which is inclined relative to horizontal, the other of said first and second guide means including pin means, said pin means extending generally transversely of said longitudinal axis of said car body, said pin means being received in said groove such that when the carriage encounters and negotiates a curve on said track, said carriage pivots about a generally vertical axis relative to said car body to thereby cause said pin means to slide in said inclined groove and thereby cause said car body to pivot about a generally horizontal axis relative to said first carriage, whereby said car body automatically tilts about a generally horizontal axis upon encountering and negotiating a curve in said track.

2. An electric toy train according to claim 1 wherein said one guide means having said groove is on said carriage and said other of said guide means having said pin means is on said car body.

3. An electric toy train according to claim 1 wherein said pin means has an axis which is disposed at an acute angle relative to horizontal when said pin means causes said car body to pivot about said generally horizontal axis relative to said carriage, said axis of said pin means being generally horizontally disposed when said pin means does not cause said car body to pivot about said generally horizontal axis relative to said carriage.

4. An electric toy train according to claim 1 wherein said other of said guide means includes a pair of circular guides, each of said circular guides having an axis which is substantially vertically disposed, said pin means extending inwardly from said pair of circular guides.

5. An electric toy according to claim 4 wherein said one guide means includes a pair of stanchions each having a circular portion, each of said circular portions being juxtaposed to one of said circular guides, each of said circular portions having an axis which is substantially vertically disposed, one of said circular portions having said groove which receives said pin means, the other of said circular portions having a second groove which also receives said pin means.

6. An electric toy train according to claim 5 wherein each of said circular guides is in a guiding relationship with said circular portions such that said pivoting of said carriage about a generally vertical axis relative to said car body is guided by said circular guides rotating relative to said circular portions and by said pins means sliding in said grooves.

7. An electric toy train according to claim 1 wherein said two axles each have a longitudinal axis, said carriage having a carriage longitudinal axis which is generally perpendicular to the longitudinal axes of said two axles, said groove having a first portion which is generally horizontally disposed and a second portion which is inclined relative to horizontal, said carriage having a non-rotated position relative to said car body in which the car body longitudinal axis is parallel to said carriage longitudinal axis, said carriage having a rotated position in which said carriage rotates about said generally vertical axis relative to said car body in which the car body longitudinal axis is disposed at an acute angle relative to said carriage longitudinal axis, said pin means being disposed in the portion of said groove when said first carriage is in said non-rotated position, said pin means being disposed in the second portion of said groove when said carriage is in said rotated position such that the pin means when in said inclined second portion of said groove is at a lower elevation than said pin means when in said first portion of said groove, whereby the car body tilts to one side relative to horizontal when said carriage is in said rotated position.

8. An electric toy train according to claim 7 wherein said one guide means includes a second groove, said first mentioned groove and said second groove each having a first horizontally disposed portion which are at the same elevation above said track.

9. An electric toy train according to claim 8 wherein said first mentioned groove and said second groove each have a second portion which is inclined relative to the respective first portion.

10. An electric toy train adapted to run on a track and to automatically tilt about a generally horizontal axis upon encountering and negotiating a curve in said track comprising a car body having a longitudinal axis, said car body having first guide means, a first and second carriage underlying said car body, said first and second carriage each having at least two parallel axles spaced from one another in a direction parallel to said longitudinal direction, each of said axles having two wheels adapted to run on said track, said first carriage having second guide means, one of said first and second guide means comprising a groove which is inclined relative to horizontal, the other of said first and second guide means including pin means, said pin means extending generally transversely of said longitudinal axis of said car body, said pin means being received in said groove such that when the first carriage encounters and negotiates a curve on said track, said first carriage pivots about a first generally vertical axis relative to said car body to thereby cause said pin means to slide in said inclined groove and thereby cause said car body to pivot about a generally horizontal axis relative to said first carriage, said car body having third guide means, said second carriage having fourth guide means, one of said third and fourth guide means comprising a channel which is inclined relative to horizontal, the other of said third and fourth guide means comprising a projection, said projection extending generally transversely of said longitudinal axis of said car body, said projection being received in said channel such that when the second carriage encounters and negotiates a curve on said track, said second carriage pivots about a second generally vertical axis relative to said car body to thereby cause said projection to slide in said inclined channel and thereby cause said car body to pivot about said generally horizontal axis relative to said second carriage.

11. A toy train adapted to run on a track and to automatically tilt upon negotiating a curve in said track comprising a car body having a longitudinal axis, said car body having a first guide structure, at least one carriage underlying said car body, said carriage having at least two parallel axles spaced from one another in a direction parallel to said longitudinal axis, each of said axles having two wheels adapted to run on said track, said carriage having a second guide structure, one of said first and second guide structures including an inclined groove which is inclined relative to said longitudinal axis of said car body, the other of said first and second guide structures including a projection which extends generally transversely of said longitudinal axis of said car body, said projection being received in said inclined groove such that when the carriage encounters and negotiates a curve on said track, said carriage pivots about a generally upright axis which is generally perpendicular to said longitudinal axis of said car body to thereby cause said projection to slide in said inclined groove and thereby cause said car body to pivot about said generally longitudinal axis of said car body, whereby said car body automatically tilts about said generally longitudinal axis of said car body upon negotiating a curve in said track.

12. A toy train according to claim 11 including a second carriage, a pivotal structure disposed between said car body and said second carriage permitting pivotal movement of said car body about said longitudinal axis relative to said second carriage as said projection slides in said groove.

13. A toy train according to claim 11 including a second carriage, said car body being designated a first sub-structure and said second carriage being designated a second sub-structure, a pivotal structure including a rounded part on one of said substructures and an engageable part on the other of said sub-structures, said rounded part engaging said engageable part such that relative pivotal movement is effected between said rounded part and said engageable part about said longitudinal axis when said car negotiates a curve in said track.

14. A toy train according to claim 13 wherein said second carriage has a longitudinal axis, said rounded part engaging said engageable part such that relative movement is effected between said rounded part and said engageable part to enable pivoting of said car body relative to said second carriage to enable said longitudinal axis of said car body to be angularly disposed relative to said longitudinal axis of said second carriage when said car body travels over a track inclined relative to horizontal, said angular relationship being in a generally vertical plane.

15. An electric toy train according to claim 11 wherein said other of said first and second guide structures include a pair of circular guides, each of said circular guides having an axis which is substantially vertically disposed, said projection extending inwardly from one of said pair of circular guides, and another projection extending inwardly from the other of said pair of circular guides.

16. An electric toy train according to claim 15 wherein said one of said first and second guide structures includes a pair of stanchions each having a circular portion, each of said circular portions being juxtaposed to one of said circular guides, each of said circular portions having an axis which is substantially vertically disposed, one of said circular portions having said groove which receives said first mentioned projection, the other of said circular portions having a second groove which receives said other projection.

17. An electric toy train according to claim 16 wherein each of said circular guides are in a guiding relationship with said circular portions such that the pivoting of said car body relative to said carriage is guided by said circular guides rotating relative to said circular portions and by said projections sliding in said grooves.

18. A toy train adapted to run on a track and to automatically tilt upon negotiating a curve in said track comprising a car body having a longitudinal axis, said car body having a first guide structure, a first and second carriage underlying said car body, said first and second carriages each having at least two parallel axles spaced from one another in a direction parallel to said longitudinal axis, each of said axles having two wheels adapted to run on said track, said first carriage having a second guide structure, one of said first and second guide structure including an inclined groove which is inclined relative to said longitudinal axis of said car body, the other of said first and second guide structures including a first projection which extends generally transversely of said longitudinal axis of said car body, said first projection being received in said inclined groove such that when the first carriage negotiates a curve on said track, said first carriage pivots about a first generally upright axis which is generally perpendicular to said longitudinal axis of said car body to thereby cause said first projection to slide in said inclined groove and thereby cause said car body to pivot about said generally longitudinal axis of said car body, said car body having a third guide structure, said second carriage having a fourth guide structure, one of said third and fourth guide structures including an inclined channel which is inclined relative to the longitudinal axis of said car body, the other of said third and fourth guide structures including a second projection which extends generally transversely of said longitudinal axis of said car body, said second projection being received in said inclined channel such that when the second carriage negotiates a curve on said track, said second carriage pivots about a second generally upright axis which is generally perpendicular to said longitudinal axis of said car body to thereby cause said second projection to slide in said inclined channel and thereby cause said car body to pivot about said generally longitudinal axis of said car body.

* * * * *